US005183091A

United States Patent [19]

Nobbe

[11] Patent Number: 5,183,091

[45] Date of Patent: Feb. 2, 1993

[54] WOODEN POLE BENDER

[76] Inventor: Paul J. Nobbe, 11177 U.S. Hwy. 52, Brookville, Ind. 47012

[21] Appl. No.: 877,643

[22] Filed: May 1, 1992

[51] Int. Cl.[5] ..... B27H 1/00

[52] U.S. Cl. ..... 144/360; 144/254; 144/270; 144/381; 269/234; 269/296

[58] Field of Search ..... 269/234, 296; 144/254, 144/255, 270, 271, 359, 362, 365, 380, 361, 360

[56] References Cited

U.S. PATENT DOCUMENTS

| | | | |
|---|---|---|---|
| 360,848 | 4/1887 | Bond | 144/381 |
| 361,123 | 4/1887 | Bond | 144/270 |
| 1,994,607 | 3/1935 | Derby | 144/254 |
| 2,081,638 | 5/1937 | Owens | 144/254 |
| 3,003,204 | 10/1961 | Bryant | 144/381 |
| 4,469,156 | 9/1984 | Norimoto et al. | 144/254 |
| 4,741,371 | 5/1988 | Lord | 144/270 |

*Primary Examiner*—W. Donald Bray

*Attorney, Agent, or Firm*—Woodard, Emhardt, Naughton, Moriarty & McNett

[57] ABSTRACT

A method and fixture for placing a permanent bend into a wooden pole. A channel shaped fixture receives the opposite ends of a wooden pole inserted therein and positions the pole above the bottom wall of the fixture. A cylindrical tube is forced downwardly against the pole by an external cylinder motor and in turn forces the pole against the bottom wall of the fixture thereby bending the pole. A pair of wedge shaped members are extended through the fixture and into the intermediate member thereby holding the intermediate member downwardly against the pole in a bent configuration while the external force is removed. The method of permanently bending a green pole includes positioning a green wooden pole shortly after harvesting in the holding fixture and then bending the pole to a bent configuration with the intermediate member. The fixture with pole in the bent configuration is then inserted into a dry kiln and heated.

17 Claims, 2 Drawing Sheets

WOODEN POLE BENDER

BACKGROUND OF THE INVENTION

1. Field of the Invention

This invention is in the field of fixtures and more specifically, those fixtures utilized to bend pieces of wood.

2. Description of the Prior Art

Various types of articles utilize bent pieces of wood. For example, furniture including-chairs may be designed to include a curved or bent wooden pole extending along the back of the furniture or chair. Since it is difficult to obtain a sufficient quantity of uniformly configured wooden trees in the natural state, it is the custom to harvest trees and to then bend the trees into the desired configuration forming the poles.

In the event the harvested wooden tree has an insect such as a beetle living therein, then eventually the bark may loosen relative to the main body of the tree since the beetle will bore into the tree. Of particular nuisance is the powder post beetle which attacks and lives within hickory trees. Beetle eggs typically will not hatch except during the warm or growing season. As a result, it has been the custom to harvest the trees during the winter when the trees are in a dormant state. Trees harvested during the dormant state are dry and brittle requiring the trees to first be subjected to heat thereby destroying any beetle eggs, and then soaked in water thereby increasing the flexibility of the trees and allowing the trees to be bent to the desired configuration. Next it is the practice to heat the trees in the bent configuration while wet setting the final configuration. Harvesting of the trees during the warm growing season has been avoided due to the fear that hatched beetles would attack the trees after the trees are harvested and dead but before heating and bending of the trees to the desired configuration. As a result, the business of harvesting and bending trees has been cyclical occurring during the winter and not during the warm growing season. I have discovered that trees can be harvested during the growing season while in the green state and bent to the desired configuration so long as the trees are bent soon after harvesting while the trees are still green and thus before the eggs are hatched. Since the trees are still green by the time of bending, the initial step of heating and wetting may be avoided with the final heating step accomplishing both the setting of the desired configuration as well as destroying any eggs or insects within the trees.

The prior method of bending dry poles harvested in the dormant state includes use of a fixture for holding a plurality of dry poles arranged in parallel fashion. The fixture includes a single rod which extends perpendicularly across the dry poles with the opposite ends of the rod fastened to the fixture thereby bending the poles. In the event, the dry poles have different diameters then the rod will bend the poles to different curvatures thereby preventing uniformity. The fixture disclosed herein eliminates this disadvantage.

SUMMARY OF THE INVENTION

One embodiment of the present invention is a method to permanently bend a green wooden pole to a final configuration by positioning a green wooden pole in a holding fixture, locating the opposite ends of the pole at predetermined elevations, forcing the center of the pole to an elevation past the elevations to bend the pole to the desired bent configuration, heating the pole while bent to kill living things foreign to but located in the pole while permanently setting the bent configuration in the pole, and, finally removing the pole from the holding fixture.

Another embodiment of the present invention is a fixture for placing a permanent bend into a wooden pole creating a bent configuration comprising a frame device with opposite portions to receive the opposite ends of the wooden pole with the frame device also including a middle portion located between the opposite portions against which the center portion of the wooden pole may be located. An intermediate member is positionable against the center portion of the pole and a force generating device with an output restable against the intermediate member is operable to force the intermediate member against the pole and the pole against the middle portion of the frame device creating a bend in the pole. A holding device is engaged with the frame device and the intermediate member and is operable to hold the intermediate member against the pole in the bent configuration even though the force generating device is removed.

It is an object of the present invention to provide a new and improved fixture for bending a wooden pole.

A further object of the present invention is to provide a method of permanently bending a green wooden pole to a final configuration.

In addition, it is an object of the present invention to provide a method and tool for bending poles harvested throughout the year.

Related objects and advantages of the present invention will be apparent from the following description.

DESCRIPTION OF THE PREFERRED EMBODIMENT

Figure 1:
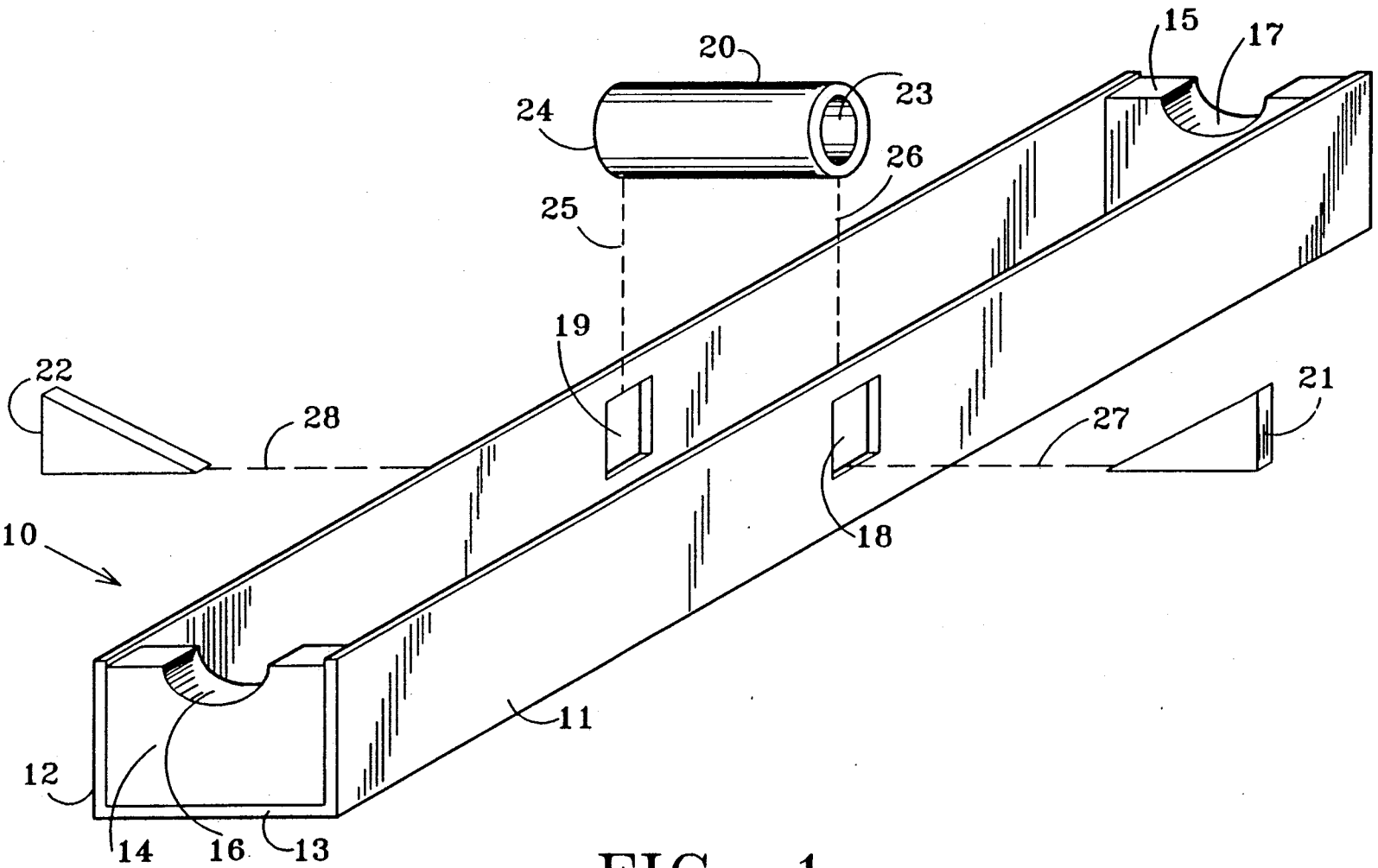
FIG. 1 is an exploded perspective view of the holding fixture incorporating the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
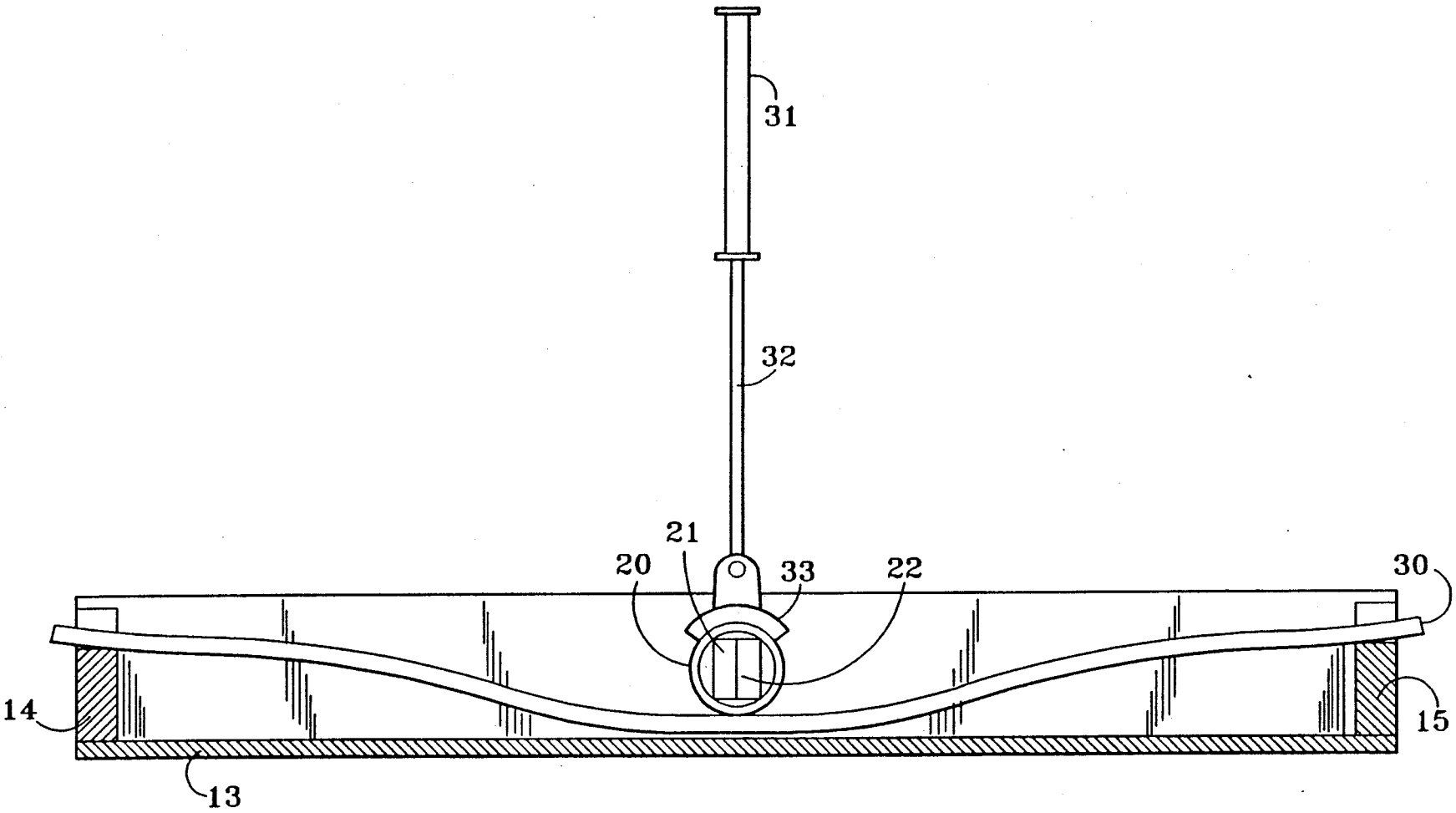
FIG. 2 is a longitudinal cross sectional view of the fixture of FIG. 1 with a wooden pole shown being forced downwardly to the bent configuration.

Referring now more particularly to FIG. 1, there is shown a holding fixture 10 to receive a wooden pole for the bending thereof. Fixture 10 includes a channel shaped main body consisting of a pair of upright walls 11 and 12 integrally joined to a bottom wall 13 with a pair of blocks 14 and 15 fixedly mounted at the opposite ends of the main body. Blocks 14 and 15 include respectively recesses 16 and 17 to receive the opposite ends of the wooden pole to be positioned in the fixture such as shown in FIG. 2.

An intermediate holding cylindrical tube 20 has a length slightly less than the distance between the spaced-apart upright walls 11 and 12 and may be positioned downwardly along dashed lines 25 and 26 against pole 30 to be aligned with the holes 18 and 19 extending through respectively upright walls 11 and 12. The width of hole 18 and hole 19 is less than the outside diameter of intermediate holding member 20 to prevent member 20 from passing through either hole. A pair of wedge shaped elements 21 and 22 are alignable respectively with holes 18 and 19 and may be moved along respectively dashed lines 27 and 28 to extend through the holes and into the opposite ends 23 and 24 of member 20. Elements 21 and 22 thus project through walls 11 and 12 into the member 20 locking the member to the walls. Each element 21 and 22 has a width approximately one half the width of hole 18 and one half the width of hole 19 enabling element 21 and 22 to be in a side by side relationship when inserted in member 20 as shown in FIG. 2.

A pneumatic or hydraulic conventional cylinder 31 includes an extendable piston rod 32 having an arcuate shaped member 33 fixedly mounted to the distal end thereof. Member 33 includes a downwardly facing surface complementary in shape to the outwardly cylindrical surface of member 20 to rest thereagainst when the piston rod is extended.

The method of permanently bending a green wooden pole to a final configuration includes the first step of harvesting a tree during the warm growing season and then positioning the green wooden tree or pole in the holding fixture so that the opposite ends of the pole rest within recesses 16 and 17. Thus, the opposite ends of the wooden pole are located at pre-determined fixed elevations each of which is located outwardly of the upwardly facing surface of bottom wall 13. The intermediate member 20 is then moved downwardly along lines 25 and 26 to be positioned atop and against the center portion of pole 30. The piston rod 32 is extended to force arcuate shaped member 33 against member 20 thereby applying external force against the intermediate member which transmits the external force directly to pole 30. Member 20 is moved sufficiently downward to align the hollow ends 23 and 24 relative to holes 18 and 19 and allowing wedges 21 and 22 to be extended through walls 11 and 12 and partially into member 20 thereby holding the intermediate member relative to walls 11 and 12 and against the pole. The external force is removed by retracting piston rod 32 while wedges 21 and 22 hold the pole in the bent configuration even upon removal of the external force. Thus, intermediate member 20 is locked to holding fixture 10 limiting relative motion therebetween.

The method further includes the step of heating the wooden pole after the pole is in the bent configuration of FIG. 2 by inserting the fixture 10 and pole 30 into a dry kiln for at least 48 hours and preferably for approximately three days at an approximate temperature of 160° F. During this heating step, any insect eggs located within the pole will be destroyed and the pole will be permanently set in the bent configuration. By utilizing a green tree or pole and inserting it into the fixture, the pole does not first have to be subjected to water since the pole will readily bend while in a green state. I have discovered that best results are obtained by placing the green pole within the fixture and then bending and heating the pole within ten days of harvesting thereby minimizing the time for hatching of any eggs located within the tree. During the heating step, all living things foreign to the pole but located in the pole will be destroyed. Once the heating step is concluded, the fixture and pole is removed from the kiln. Wedges 21 and 22 and then removed along with intermediate member 20 and the pole may be removed from the fixture in the permanent bent configuration.

Many variations are contemplated and included in the present invention. For example, the fixture may be utilized to permanently bend a wooden pole even though the pole is not in the green condition. In such a case, the wooden pole is positioned in the holding fixture and the center of the pole is forced against the bottom wall of the fixture to cause the pole to assume a bent configuration such as shown in FIG. 2. The wooden pole if dry may be wetted with hot water. Similarly, the pole while bent may be inserted into the kiln to kill living things foreign to the pole.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method of permanently bending a green wooden pole to a final configuration comprising the steps of:

positioning a green wooden pole in a holding fixture;

locating the opposite ends of said pole at predetermined elevations;

forcing the center of said pole to an elevation past said elevations to bend said pole to the desired bent configuration;

heating said pole while bent to simultaneously kill living things foreign to but located in said pole while permanently setting said bent configuration in said pole; and, removing said pole from said holding fixture.

2. The method of claim 1 and comprising the further step of:

harvesting said pole during the warm growing season within ten days prior to said positioning and heating steps.

3. The method of claim 1 wherein said forcing step includes the sub-steps of:

locating an intermediate member against said pole at said center;

applying external force against said intermediate member transmitting said external force to said pole;

removing said external force from said intermediate member; and, holding said intermediate member against said pole to maintain said pole in said bent configuration upon removal of said external force.

4. The method of claim 3 wherein:

said holding sub-step includes locking said intermediate member and said holding fixture together.

5. The method of claim 4 wherein:

said holding sub-step includes extending an element through said holding fixture and said intermediate member limiting relative motion therebetween.

6. The method of claim 5 wherein:

said heating step includes placing said holding fixture with a green wooden pole therein into a dry kiln for approximately 3 days at an approximate temperature of 160° F.

7. A method of permanently bending a wooden pole to a final configuration comprising the steps of:

positioning a wooden pole in a holding fixture;

locating the opposite ends of said pole at predetermined elevations;

forcing the center of said pole to an elevation past said elevations to bend said pole to the desired bent configuration;

heating said pole while bent to simultaneously destroy living things foreign to but located in said pole while permanently setting said bent configuration in said pole; and, removing said pole from said holding fixture.

8. The method of claim 7 and comprising the further step of:

maintaining said pole in a heated state during said heating step for at least 48 hours.

9. The method of claim 7 wherein said forcing step includes the sub-steps of:

locating an intermediate member against said pole at said center;

applying external force against said intermediate member transmitting said external force to said pole;

removing said external force from said intermediate member; and, holding said intermediate member against said pole to maintain said pole in said bent configuration upon removal of said external force.

10. The method of claim 9 wherein:

said holding sub-step includes locking said intermediate member and said holding fixture together.

11. The method of claim 10 wherein:

said holding sub-step includes extending an element through said holding fixture and said intermediate member limiting relative motion therebetween.

12. The method of claim 11 wherein:

said heating step includes placing said holding fixture with wooden pole therein into a dry kiln for approximately 3 days at an approximate temperature of 160° F.

13. A fixture for placing a permanent bend into a wooden pole creating a bent configuration comprising:

frame means with opposite portions to receive the opposite ends of a wooden pole with said frame means also including a middle portion located between said opposite portions against which the center portion of the wooden pole may be located;

an intermediate member positionable against said center portion of said pole;

force generating means with an output restable against said intermediate member operable to force said intermediate member against said pole and said pole against said middle portion of said frame means creating a bend in said pole; and, holding means engaged with said frame means and said intermediate member operable to hold said intermediate member against said pole in said bent configuration even though said force generating means is removed.

14. The fixture of claim of claim 13 wherein:

said intermediate member includes a first surface and said force generating means includes a second surface mutually opposed to said first surface, said force generating means when against said intermediate member is unattached relative thereto but has said second surface force against said first surface.

15. The fixture of claim 14 wherein:

said frame means includes a side wall with a hole extending therethrough;

said holding means includes an elongated element extendable through said hole into said intermediate means to limit relative motion between said intermediate means and said frame means.

16. the fixture of claim 15 wherein:

said holding means includes a pair of wedges extendable into opposite ends of said intermediate means which is a hollow cylinder.

17. The fixture of claim 16 wherein:

said frame means is a channel with said opposite portions of said frame means including recesses formed thereon to receive the opposite ends of said pole.

* * * * *

UNITED STATES PATENT AND TRADEMARK OFFICE

CERTIFICATE OF CORRECTION

PATENT NO. : 5,183,091

DATED : February 2, 1993

INVENTOR(S) : Paul J. Nobbe

It is certified that error appears in the above-identified patent and that said Letters Patent is hereby corrected as shown below:

Column 4, line 2, replace the word "and" with the word --are--.

Signed and Sealed this

Ninth Day of November, 1993

Bruce Lehman

*Attest:*

BRUCE LEHMAN

*Attesting Officer*

*Commissioner of Patents and Trademarks*